US008295126B2

(12) United States Patent
Wood et al.

(10) Patent No.: US 8,295,126 B2
(45) Date of Patent: Oct. 23, 2012

(54) METHOD AND APPARATUS FOR PROCESSING A CALENDAR DATABASE FOR TIME ZONE SHIFTING

(75) Inventors: Todd Wood, Waterloo (CA); Jason Griffin, Waterloo (CA); Carlos Perez, St. George (CA)

(73) Assignee: Research In Motion Limited, Waterloo, ON (CA)

( * ) Notice: Subject to any disclaimer, the term of this patent is extended or adjusted under 35 U.S.C. 154(b) by 166 days.

(21) Appl. No.: 12/392,231

(22) Filed: Feb. 25, 2009

(65) Prior Publication Data

US 2010/0214878 A1 Aug. 26, 2010

(51) Int. Cl.
*G04B 19/22* (2006.01)
*G04B 19/24* (2006.01)

(52) U.S. Cl. ..... 368/21; 368/28

(58) Field of Classification Search ..... 368/21, 368/29, 28, 30; 705/7.18
See application file for complete search history.

(56) References Cited

U.S. PATENT DOCUMENTS

| | | | | |
|---|---|---|---|---|
| 4,681,460 | A * | 7/1987 | Nishimura | 368/21 |
| 5,006,985 | A * | 4/1991 | Ehret et al. | 705/1.1 |
| 5,023,851 | A * | 6/1991 | Murray et al. | 368/41 |
| 6,219,307 | B1 * | 4/2001 | Chitturi | 368/223 |
| 6,249,486 | B1 * | 6/2001 | Chitturi | 368/21 |
| 6,553,037 | B1 | 4/2003 | Pivowar et al. | |
| 6,647,370 | B1 | 11/2003 | Fu et al. | |
| 6,934,740 | B1 | 8/2005 | Lawande et al. | |
| 7,586,399 | B2 * | 9/2009 | Joo | 340/309.16 |
| 7,689,448 | B2 * | 3/2010 | Fu et al. | 705/8 |
| 2001/0014890 | A1 | 8/2001 | Liu et al. | |
| 2002/0038234 | A1 | 3/2002 | Fu et al. | |
| 2008/0186807 | A1 * | 8/2008 | Jain et al. | 368/10 |
| 2009/0281859 | A1 * | 11/2009 | Isaacson | 705/8 |

FOREIGN PATENT DOCUMENTS

CA 2604586 A1 11/2006

OTHER PUBLICATIONS

Lifehacker :: http://lifehacker.com/#!391167/kwiry-offers-picture+based-reminders-for-your-phone; Apr. 25, 2011.*
Secureremind :: secureremind.com; Apr. 18, 2011.*
European Patent Application No. 09 15 3662 Search Report dated Jul. 22, 2009.
Corresponding Canadian Patent Application No. 2691325 Office Action dated May 30, 2012.

* cited by examiner

*Primary Examiner* — Sean Kayes
(74) *Attorney, Agent, or Firm* — Perry + Currier

(57) ABSTRACT

A system, method and apparatus for processing a calendar database for time zone shifting are provided. The calendar database is processed to determine a first set of event data associated with a first time zone and a second set of event data associated with a second time zone. Time zone calendar view data is produced, the time zone calendar view data enabled to control a display device to produce a time zone calendar view comprising representations of the first set and the second set sorted according to their associated time zones, said representations displayed on a timeline adjacent to one another, with concurrent times in each of the first time zone and second time zone temporally aligned. A display device is controlled, via the time zone calendar view data, to produce the time zone calendar view.

10 Claims, 7 Drawing Sheets

METHOD AND APPARATUS FOR PROCESSING A CALENDAR DATABASE FOR TIME ZONE SHIFTING

FIELD

The specification relates generally to databases, and specifically to a method and apparatus for processing a calendar database for time zone shifting.

BACKGROUND

When a computing device (e.g. laptop, PDA, and the like) that is enabled to process a calendar database is transported to a time zone that is different from a time zone where it is usually located, resources at the computing device are often used inefficiently to process event data (e.g. meeting data and reminder data associated with time-based events) that is not relevant to its current location. For example, a "home" time zone location can be Eastern Standard Time (EST-5:00) and the computing device can have been transported to a "travel" time zone, such as Greenwich Mean Time (GMT 0:00). A meeting which is in the calendar database, but which is occurring in the home time zone, may not be relevant in the travel time zone. Nonetheless, when the time zone at a computing device is switched upon arrival in the travel time zone (e.g. from EST to GMT), event data associated with the home time zone is still processed such that reminder data etc. is provided by the computing device that is generally irrelevant. For example, a regular 6 am calendar reminder may go off at 1 am, but it is not relevant. Furthermore, event data associated with a meeting that occurs in the home time zone at 4 pm EST can be provided as occurring at 11 am GMT, which further causes general confusion.

BRIEF DESCRIPTIONS OF THE DRAWINGS

Embodiments are described with reference to the following figures, in which.

DETAILED DESCRIPTION OF THE EMBODIMENTS

Figure 1:
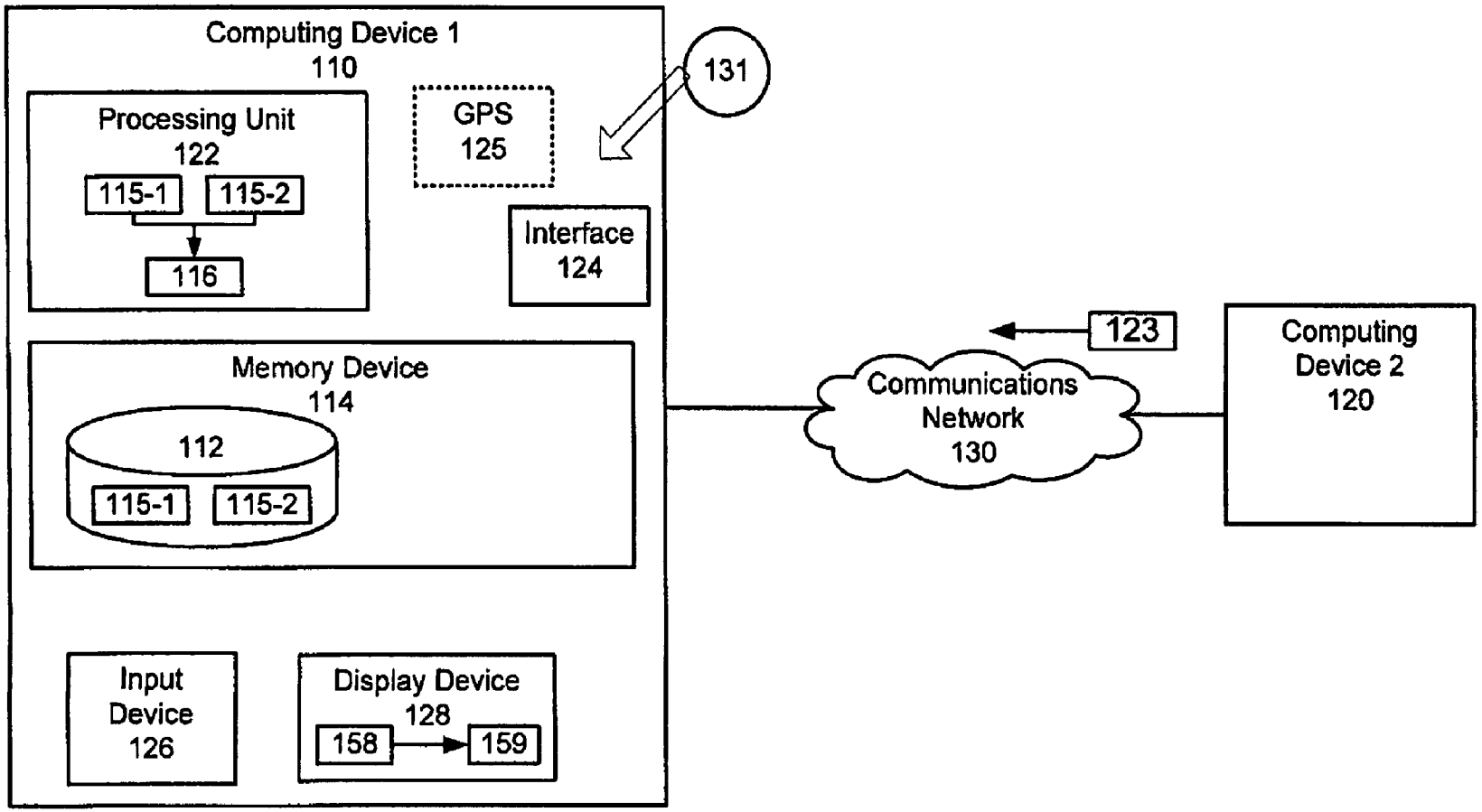
FIG. 1 depicts a first computing device for processing a calendar database for time zone shifting, according to non-limiting embodiments.

A first aspect of the present specification provides a method for processing a calendar database for time zone shifting, the calendar database stored at a memory device, the method implementable in a computing device enabled to control a display device. The method comprises processing the calendar database to determine a first set of event data associated with a first time zone and a second set of event data associated with a second time zone. The method further comprises producing time zone calendar view data enabled to control a display device to produce a time zone calendar view comprising representations of the first set and the second set, the first set and the second set sorted according to their associated time zones, the representations displayed on a timeline adjacent to one another, with concurrent times in each of the first time zone and the second time zone temporally aligned. The method further comprises controlling the display device via the time zone calendar view data to produce the time zone calendar view.

The method can further comprise: determining which of the first time zone and the second time zone comprises a current time zone and, accordingly, which of the first set and the second set, respectively, comprises current time zone event data; processing current time zone reminder data, associated with the current time zone event data, to incorporate the current time zone reminder data into the time zone calendar view data, such that the current time zone reminder data is displayed in the time zone calendar view at a time, in the current time zone, specified in the current time zone reminder data. The method can further comprise: determining whether there is data indicative of processing other time zone reminder data present in the calendar database; and, if so: determining which of the first time zone and the second time zone comprises a time zone other than the current time zone and, accordingly, which of the first set and the second set, respectively, comprises other time zone event data; and processing other time zone reminder data associated with the other time zone event data to incorporate the other time zone reminder data into the time zone calendar view data such that the other time zone reminder data is displayed in the time zone calendar view at a time, in the current time zone, specified in the other time zone reminder data shifted to the current time zone. Determining which of the first time zone and the second time zone comprises a current time zone can comprise at least one of: querying a communication network to determine the current time zone and comparing the current time zone with time zone data stored in the first set and second set; receiving input data from an input device, the input data indicative of the current time zone, and comparing the event data with the time zone data; querying a Global Positioning System (GPS) device to determine a current location and accessing a location-time zone database to determine the current time zone based on the current location; and querying the communication network to determine a network identifier and accessing a database of communication network identifiers to determine the current time zone based on the network identifier.

The method can further comprise at least one of moving and copying event data from a first one of the first set and the second set to the other of the first set and the second set.

A second aspect of the specification provides a computing device for processing a calendar database for time zone shifting. The computing device comprises a memory for storing the calendar database. The computing device further comprises a processing unit in communication with the memory. The processing unit is enabled to process the calendar database to determine a first set of event data associated with a first time zone and a second set of event data associated with a second time zone. The processing unit is further enabled to produce time zone calendar view data enabled to control a display device to produce a time zone calendar view comprising representations of the first set and the second set, the first set and the second set sorted according to their associated time zones, the representations displayed on a timeline adjacent to one another, with concurrent times in each of the first time zone and the second time zone temporally aligned. The processing unit is further enabled to control the display device via the time zone calendar view data to produce the time zone calendar view.

The processing unit can be further enabled to: determine which of the first time zone and the second time zone comprises a current time zone and, accordingly, which of the first set and the second set, respectively, comprises current time zone event data; and process current time zone reminder data, associated with the current time zone event data, to incorporate the current time zone reminder data into the time zone calendar view data, such that the current time zone reminder data is displayed in the time zone calendar view at a time, in the current time zone, specified in the current time zone reminder data. The processing unit can be further enabled to: determine whether there is data indicative of processing other time zone reminder data present in the calendar data base; and if so: determine which of the first time zone and the second time zone comprises a time zone other than the current time zone and, accordingly, which of the first set and the second set, respectively, comprises other time zone event data; and process other time zone reminder data associated with the other time zone event data to incorporate the other time zone reminder data into the time zone calendar view data such that the other time zone reminder data is displayed in the time zone calendar view at a time, in the current time zone, specified in the other time zone reminder data shifted to the current time zone. The processing unit can be further enabled to determine which of the first time zone and the second time zone comprises a current time zone by at least one of: querying a communication network to determine the current time zone and comparing the current time zone with time zone data stored in the first set and the second set, the computing device further comprising a communication interface enabled for the querying the communication network; receiving input data from an input device, the input data indicative of the current time zone and comparing the event data with the time zone data, the computing device comprising the input device enabled for receiving input data; querying a Global Positioning System (GPS) device to determine a current location and accessing a location-time zone database to determine the current time zone based on the current location; and querying the communication network to determine a network identifier and accessing a database of communication network identifiers to determine the current time zone based on the network identifier.

The processing unit can be further enabled to implement at least one of moving and copying event data from a first one of the first set and the second set to the other of the first set and the second set.

FIG. 1 depicts a first computing device 110 for processing a calendar database 112 for time zone shifting, calendar database 112 stored at a memory device 114, first computing device 110 enabled to control a display device 128, according to non-limiting embodiments. First computing device 110 comprises a processing unit 122, a communications interface 124 and memory device 114, all in communication, for example, via a computing bus. First computing device 110 further comprises an input device 126 and a display device 128. In other embodiments, input device 126 and display device 128 can be external to first computing device 110, and first computing device 110 is in communication with input device 126 and display device 128.

Figure 2:
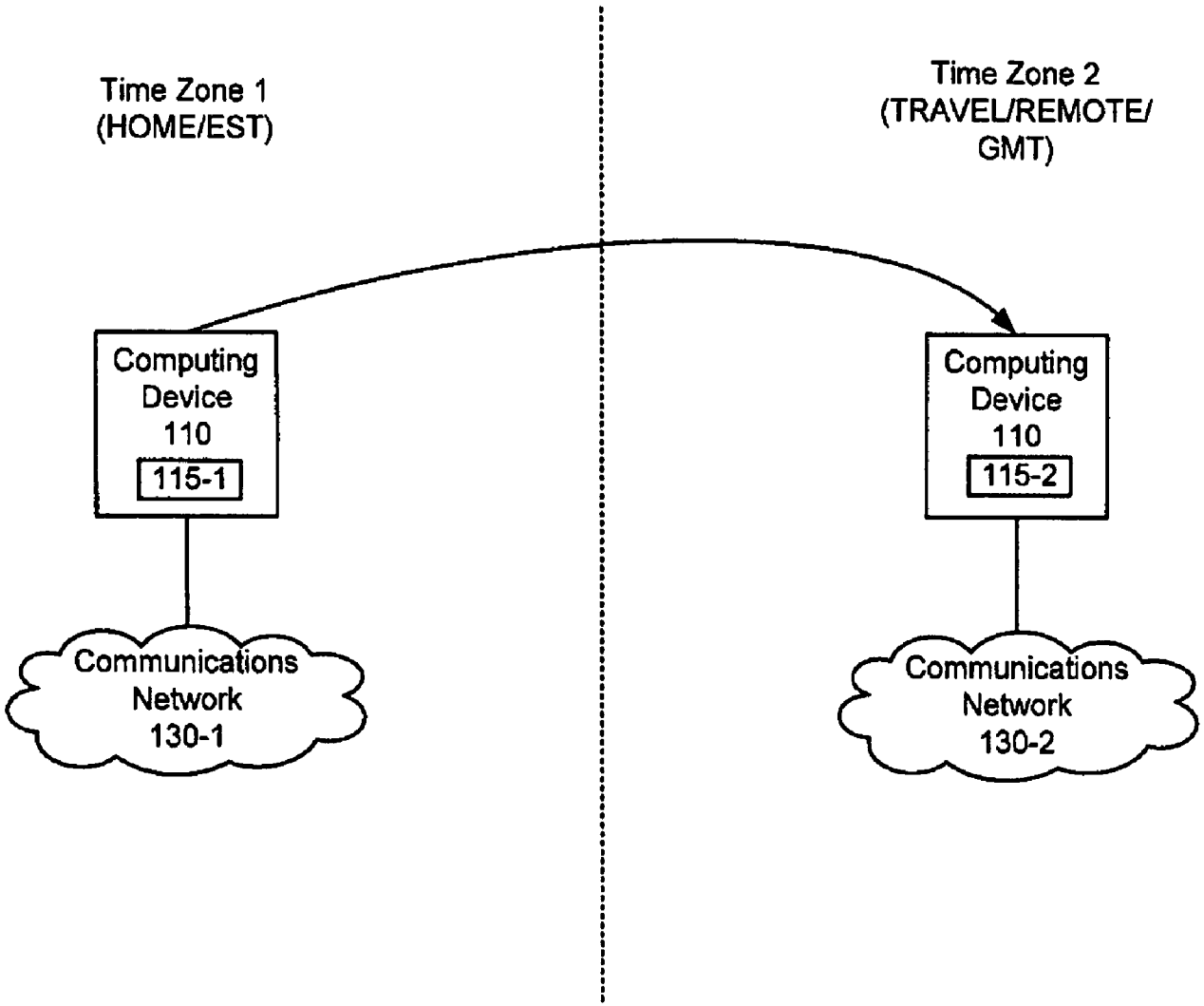
FIG. 2 depicts the first computing device of FIG. 1 being transported from a first time zone to a second time zone, according to non-limiting embodiments.

First computing device 110 is generally enabled to process calendar database 112 to determine a first set of event data 115-1 associated with a first time zone and a second set of event data 115-2 associated with a second time zone. For example, as depicted in FIG. 2, first computing device 110 can be transported from a first time zone (e.g. a home time zone) to a second time zone (e.g. a remote time zone) via planes, trains and/or automobiles, and the like. First event data 115-1 stored in calendar database 112 can be associated with events, meetings and the like that occur in the first time zone, while second event data 115-2 stored in calendar database 112 can be associated with events, meetings and the like that occur in the second time zone. While in FIG. 2 only first event data 115-1 is depicted as stored at computing device 110 in first time zone, and second event data 115-2 is depicted as stored at computing device 110 in second time zone, it is understood that both first and second event data 115-1, 115-2 are stored at computing device 110 regardless of where computing device 110 is located.

In some embodiments, as depicted, first computing device 110 is in communication with a second computing device 120 via a communication network 130. Event data 123 (e.g. meeting invitations) can be received from second computing device 120 and stored in calendar database 112. Furthermore, processing unit 122 can be enabled to process event data 123 such that event data 123 is categorized as first or second event data 115-1, 115-2, and stored appropriately.

Furthermore, first computing device 110 is generally enabled to determine which time zone within which it is located. For example, in first time zone, computing device 110 can be in communication with a communication network 130-1 associated with first time zone (including but not limited to communication network 130 of FIG. 1); in second time zone, computing device 110 can be in communication with a communication network 130-2 associated with second time zone. In particular, computing device 110 can determine in which time zone it is located by querying communication network 130-1, 130-2, local to the time zone. However, in some embodiments, computing device 110 can be enabled to determine in which times zone it is located only with certain networks. For example, in some embodiments, computing device 110 can be compatible with communications network 130-1, but not communications network 130-2, as described below.

In some embodiments, first computing device 110 can further comprise a GPS (Global Positioning System) device 125. Using GPS device 125, first computing device 110 can determine a current location and compare it to a database (at first computing device 110 and/or the device accessible via communications network 130) to determine in which time zone it is located.

In some embodiments, a determination of which time zone first computing device 110 is located in can be made by determining an identifier of communications network 130 and comparing the identifier to a database.

Figure 3:
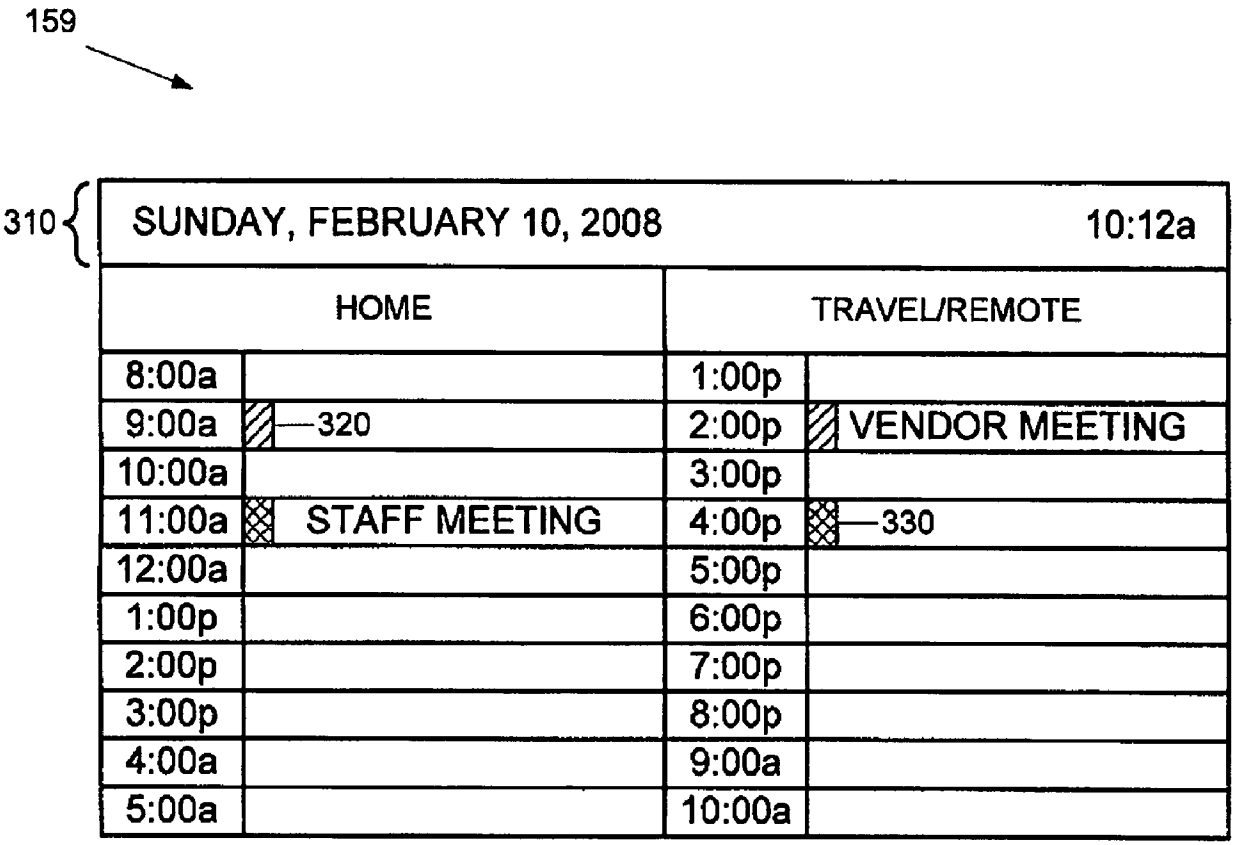
FIG. 3 depicts a representation of first and second sets of event data, according to non-limiting embodiments.

Returning to FIG. 1, processing unit 122 is enabled to produce time zone calendar view data 116 enabled to control display device 128 to produce a representation 159 of a time zone calendar view comprising representations of first and second sets of event data, 115-1, 115-2, each set 115 sorted according to time zone and displayed on a timeline adjacent to one another, with concurrent times in each of first and second time zones 115-1, 115-2 temporally aligned. Processing unit 122 is further enabled to control display device 128 via time zone calendar view data 116 to produce time zone calendar view 159. Non-limiting embodiments of representation 159 is depicted in FIG. 3, described below.

Returning now to FIG. 1, first computing device 110 comprises any suitable process calendar database 112 to determine a first set of event data 115-1 associated with a first time zone and a second set of event data 115-2 associated with a second time zone, and for processing application 131, including but not limited to any suitable combination of personal computers, laptops, servers in client-server environments, mobile electronic devices, PDA's, cell phones and the like. Other suitable types of computing devices are within the scope of present embodiments.

Communications interface 124 is enabled to receive event data, meeting requests and the like from second communication device 120 via communications network 130. Accordingly, communications interface 124 is enabled to communicate via communications network 130 according to any suitable protocol which is compatible with communications network 130. Further, communications interface 124 is enabled to communicate in a wireless or wired manner, as desired, compatible with communications network 130, including but not limited to packet based protocols, Internet protocols, analog protocols, PSTN protocols, cell phone protocols (1X, UTMS, CDMA, GMS, and the like), WiFi protocols, WiMax protocols and/or a combination. Other suitable protocols are within the scope of present embodiments.

Similarly, communication networks 130, can comprise any suitable combination of wired and/or wireless networks, including but not limited to packet based networks, the Internet, analog networks, the PSTN, LAN, WAN, cell phone networks, WiFi networks, WiMax networks and/or a combination. Other suitable types of communication networks are within the scope of present embodiments.

Furthermore, in some embodiments, communications interface 124 can be enabled to communicate with communications networks 130-1, 130-2, which can be similar or different to communications network 130. In some embodiments, communications network 130-2 (i.e. the remote communications network) can be different from communications network 130-1; indeed, in some embodiments, in second time zone, communications interface 124 may not be able to communicate with communications network 130-2. For example, communications network 130-2 can operate via protocols and/or radio frequencies different from communications network 130-1.

Display module 128 comprises circuitry 158 for generating representation 159. Display module 128 can include any suitable combination of CRT and/or flat panel displays (e.g. LCD, plasma and the like), and circuitry 158 can include any suitable combination of circuitry for controlling the CRT and/or flat panel displays etc., including but not limited to display buffers, transistors, electron beam controllers, LCD cells, plasmas cells, phosphors etc. In particular, display module 128 and circuitry 158 can be controlled by processing unit 122 to generate representation 159.

Input device 126 is generally enabled to receive input data, and can comprise any desired combination of suitable input devices, including but not limited to a keyboard, a pointing device, a mouse, a track wheel, a touchpad, a touch screen and the like. In alternative embodiments input data can be received at first computing device 110 via communications interface 124 and/or communications network 130, for example from other computing devices such as second computing device 120.

Memory device 114 can be any suitable combination of persistent memory, temporary memory, RAM, ROM and the like.

First event data 115-1 generally comprises event data associated with first time zone. Non-limiting examples of first event data 115-1 is presented in Table 1:

TABLE 1

| | |
|---|---|
| Date | Sunday Feb. 10, 2008 |
| Time Zone | Home (Eastern Standard Time) |
| 8:00 a | |
| 9:00 a | |
| 10:00 a | |
| 11:00 a | Staff Meeting |
| 12:00 p | |
| 1:00 p | |
| 2:00 p | |
| 3:00 p | |
| 4:00 p | |
| 5:00 p | |

Though the non-limiting example of first event data 115-1 in Table 1 is presented in cells arranged in rows and columns, it is understood that first event data can be stored in calendar database 112 in any suitable format. In any event, Table 1 comprises a cell representing a date of the events stored in Table 1 ("Sunday Feb. 10, 2008") and a cell representing the time zone (e.g. first time zone) associated with the events stored in Table 1 ("Home (Eastern Standard Time)"). It is hence understood that the events stored in Table 1 are to occur in the "Home" time zone, which in this non-limiting example is "Eastern Standard Time". Table 1 further comprises a column comprising times of the day ("8:00 a, 9:00 a, . . . , 5:00 p"), and an adjacent column comprising each event which occurs at a respective time. For example, "Staff Meeting" is to occur at 11:00 a, in the "Home" time zone. It is understood that events can occur before the earliest time listed in Table 1 and/or after the latest time listed in Table 1 as desired.

Furthermore, in some embodiments, first event data 115-1 can comprise reminder data. For example, each respective event associated with first event data 115-1 can be associated with reminder data in first event data 115-1, reminder data indicative of a time and/or date when a reminder of a respective event is to be provided. In a particular non-limiting embodiment, reminder data of the event "Staff Meeting" can comprise "Provide Reminder 15 Minutes Prior to Beginning of Meeting". However, reminder data can be in any suitable format and/or can comprise any suitable time period and/or any suitable time/date, etc.

Similarly, second event data 115-2 generally comprises event data associated with second time zone. Non-limiting examples of first event data 115-2 is presented in Table 2:

TABLE 2

| | |
|---|---|
| Date | Sunday Feb. 10, 2008 |
| Time Zone | TRAVEL (Greenwich Mean Time) |
| 1:00 p | |
| 2:00 p | Vendor Meeting |
| 3:00 p | |
| 4:00 p | |
| 5:00 p | |
| 6:00 p | |
| 7:00 p | |
| 8:00 p | |
| 9:00 p | |
| 10:00 p | |

Though the non-limiting example of second event data 115-2 in Table 2 is presented in cells arranged in rows and columns, it is understood that second event data can be stored in calendar database 112 in any suitable format. In any event, Table 2 comprises a cell representing the date of the events stored in Table 2 ("Sunday Feb. 10, 2008") and a cell representing the time zone (e.g. second time zone) associated with the events stored in Table 2 ("Travel (Greenwich Mean Time)"). It is hence understood that the events stored in Table 2 are to occur in the "Travel"/remote time zone, which in this non-limiting example is "Greenwich Mean Time". Table 2 further comprises a column comprising times of the day ("1:00 p, 2:00 p, . . . 10:00 p"), and an adjacent column comprising each event which occurs at a respective time. For example, "Vendor Meeting" is to occur at 2:00 p, in the "Travel" time zone. It is understood that events can occur before the earliest time listed in Table 2 and/or after the latest time listed in Table 2 as desired.

Furthermore, in some embodiments, second event data 115-2 can comprise reminder data. For example, each respective event associated with second event data 115-2 can be associated with reminder data in second event data 115-2, reminder data indicative of a time and/or date when a reminder of a respective event is to be provided. In a particular non-limiting embodiment, reminder data of the event "Vendor Meeting" can comprise "Provide Reminder 1 Hour Prior to Beginning of Meeting". However, reminder data can be in any suitable format and/or can comprise any suitable time period and/or any suitable time/date, etc.

Second computing device 120, if present, can be similar to first computing device 110, and though not depicted is understood to comprise a processing unit, memory, communication interface interconnected via computer bus and the like, etc. Furthermore, second computing device 120 can be generally enabled to generate and transmit event data to first computing device 110.

Figure 4:
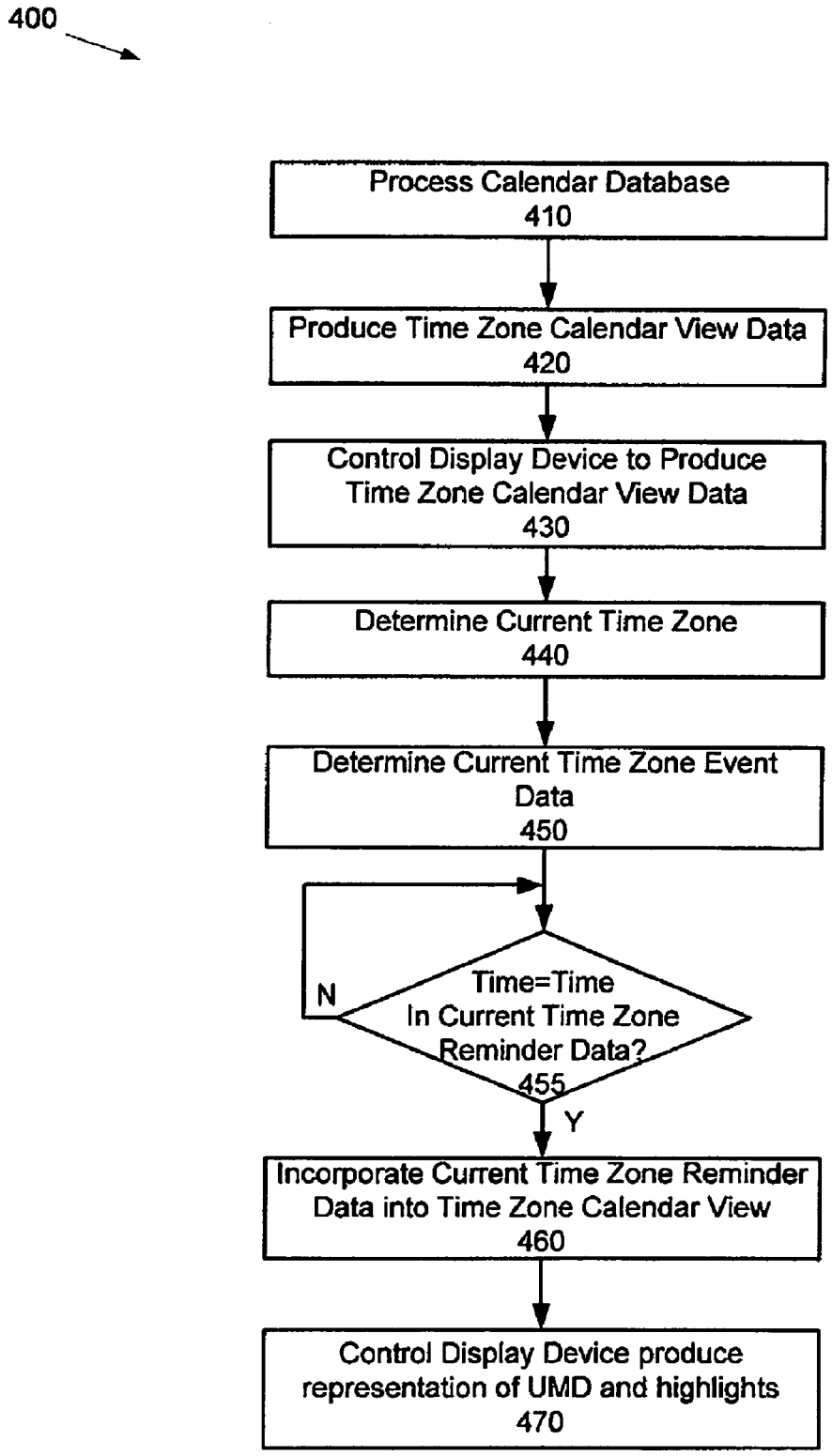
FIG. 4 depicts a method for processing a calendar database for time zone shifting, according to non-limiting embodiments.

Attention is now directed to FIG. 4 which depicts a method 400 for processing a calendar database for time zone shifting, the calendar database stored at a memory device, method 400 implementable in a computing device enabled to control a display device. In order to assist in the explanation of the method 400, it will be assumed that the method 400 is performed using computing device 110. Specifically, it is assumed method 400 is performed using computing device 110 storing calendar database 112 in memory device 114, and that computing device 110 is enabled to control display device 128. Furthermore, the following discussion of the method 400 will lead to a further understanding of the system 100 and its various components. However, it is to be understood that computing device 110 and/or the method 400 can be varied, and need not work exactly as discussed herein in conjunction with each other, and that such variations are within the scope of present embodiments. For example, in other embodiments, calendar database 112 can be stored remotely from computing device 110, calendar database accessible via a suitable communications network (such as communications networks 130, 130-1 and/or 130-2).

At step 410, calendar database 112 is processed, for example, by processing unit 122, to determine first set of event data 115-1 associated with first time zone and second set of event data 115-2 associated with second time zone, for example first and second time zones from FIG. 2.

At step 420, time zone calendar view data 116 is produced (as depicted in FIG. 1). In general, time zone calendar view data 116 is enabled to control display device 128 to produce representation 159 comprising time zone calendar view, for example as depicted in FIG. 3. Time zone calendar view generally comprises representations of the first set of event data 115-1 and second set of event data 115-2, each set sorted according to time zone and displayed on a timeline adjacent to one another, with concurrent times in each of the first and second time zones temporally aligned.

With reference to FIG. 3, in these embodiments, representation 159 comprises a header 310 comprising data associated with the current date and current local time (e.g. Sunday Feb. 10, 2008 at 10:12 a) in any suitable format. Representation 159 further comprises two columns, a "Home" column comprising the contents of Table 1, and a "Travel" column comprising the contents of Table 2. Each of the Home and Travel columns represents a timeline of events in each of the first and second time zones, respectively, displayed adjacent to one another, with the concurrent times in each of the first and second time zones temporally aligned. In other words, 8:00 a in first time zone is concurrent with 1:00 p in second time zone, 9:00 a in first time zone is concurrent with 2:00 p in second time zone, etc.

In some embodiments, as depicted, representation 159 can further comprise a first graphical indication 320 in the "Home" column (i.e. in first time zone) that an event is occurring in second time zone. Graphical indication 320 is located at a time in the "Home" column which is concurrent with the time of the event in the second time zone. Similarly, representation 159 can further comprise a second graphical indication 330 in the "Travel" column (i.e. in second time zone) that an event is occurring in first time zone. Graphical indication 330 is located at a time in the "Travel" column which is concurrent with the time of the event in the first time zone. Representation 159 can comprise any suitable number of graphical indications, similar to graphical indication 320, 330, each graphical indication in one column (i.e. one time zone) concurrent with events in the other of the two time zones.

At step 430, display device 128 is controlled, via the time zone calendar view data 116, to produce the time zone calendar view. For example, circuitry 158 is controlled to produce representation 159 as depicted in FIG. 3.

At step 440, a current time zone is determined. In some embodiments, step 440 can occur at any suitable step prior to or during step 430, and the current time zone can be indicated within representation 159.

Figure 5:
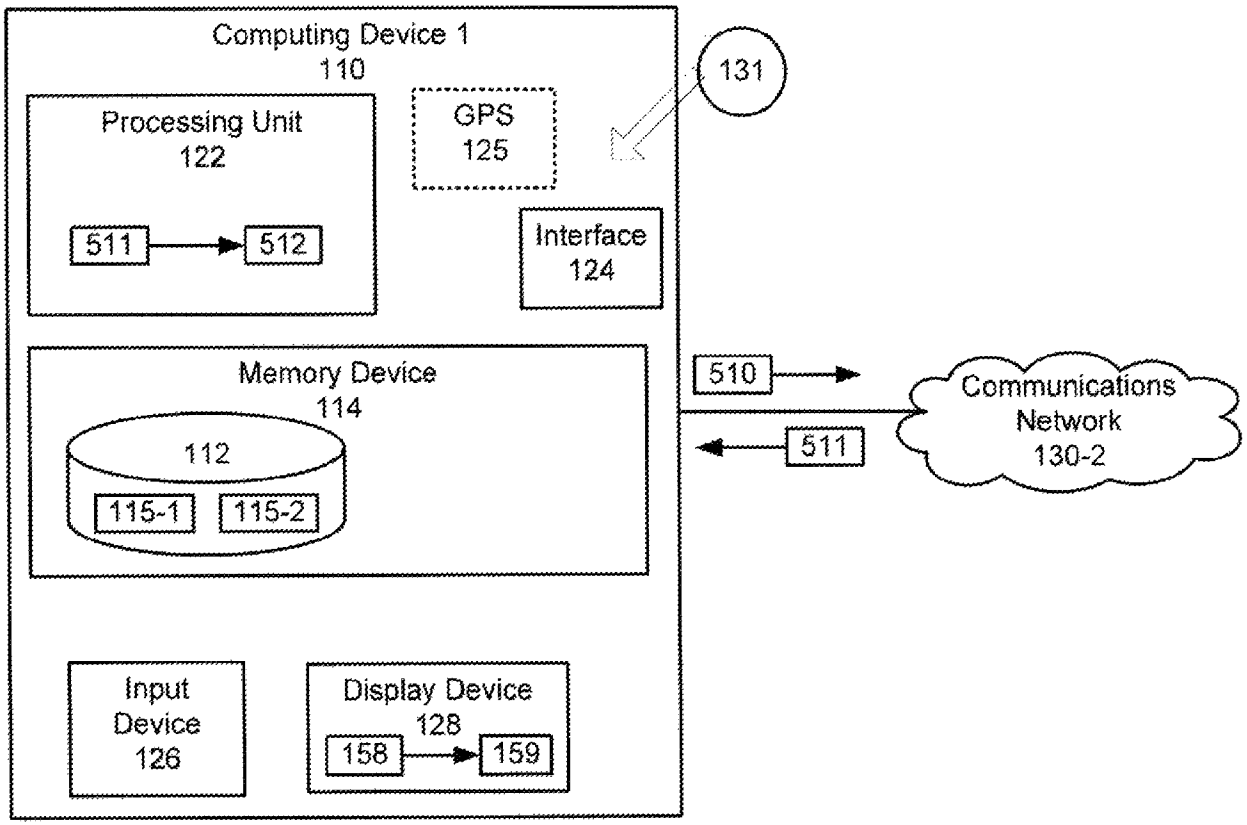
FIG. 5 depicts the first computing device of FIG. 1 requesting time zone data from a communications network in a travel time zone, according to non-limiting embodiments.

In any event, at step 440, in some embodiments, a current time zone can be determined by querying a communications network to determine the current time zone. In general, a communications network local to the current time zone can be queried: if the current time zone is first time zone, as in FIG. 2, then communications network 130-1 can be queried; if the current time zone is second time zone, as in FIG. 2, then communications network 130-2 can be queried. For example, as depicted in FIG. 5, computing device 110 is assumed to be in second time zone (as in FIG. 2) and a request 510 is transmitted to communications network 130-2. In some embodiments, request 510 comprises a request to register on communications network 130-2 (including but not limited to instances of "roaming"), while in other embodiments, request 510 comprises a request for the local time and/or current time zone.

Request 510 is received by any suitable computing device within or connected to communications network 130-2, and a reply 511 is transmitted to computing device 110, reply 511 comprising data representative of the local time and/or current time zone. Reply 511 can then be processed by the processing unit 122 to determine data 512 representative of the current time zone.

If reply 511 comprises data representative of the local time, but not the current time zone, a determination of data 512 can be made by comparing the local time compared to a time stored in the computing device 110: e.g. in some embodiments, computing device 110 can comprise a suitable clock module (any suitable combination of hardware and software) and the local time can be compared to the time kept by the clock module, which general will be the time local to first time zone (assuming that computing device 110 is transported from first time zone to second time zone, without updates to the time stored by the clock module).

In other embodiments, a current time zone can be determined by receiving input data from input device 126, the input data indicative of the current time zone. For example, upon arriving in a new time zone (e.g. on a business trip or vacation), a user of computing device 110 can enter the input data into input device 126.

In yet further embodiments, a current time zone can be determined by first determining a current location via GPS device 125 and comparing a current location against a suitable database. Similarly, in other embodiments, a current time zone can be determined by first determining an identifier of a communications network which is in communication with first computing device 110, and comparing such an identifier against a suitable database.

At step 450, current time zone event data is determined by comparing the current time zone with time zone data stored in the first and second event data to determine which of the first and second time zones comprises the current time zone and hence which of the first and second event data, respectively, comprises current time zone event data.

At step 455 it is determined if a current time matches a time indicated in current time zone reminder data. If not, step 455 is repeated until a current time matches a time indicated in current time zone reminder data.

If so, at step 460 current time zone reminder data associated with the current time zone event data is processed to incorporate the current time zone reminder data into the time zone calendar view data 116 such that the current time zone reminder data is displayed in the time zone calendar view at a time, in the current time zone, specified in current time zone reminder data.

Figure 6:
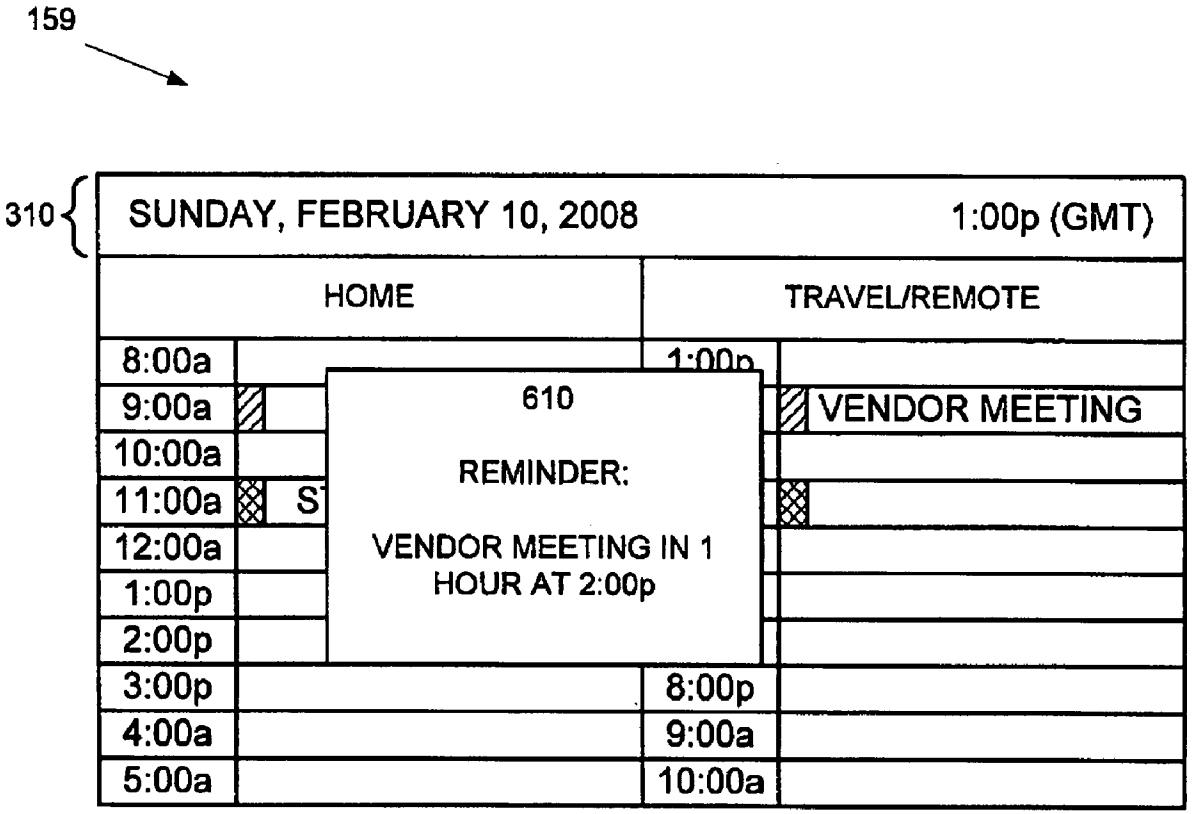
FIGS. 6 and 7 depict a representation of first and second sets of event data, with reminder data provided therein, according to non-limiting embodiments.

At step 470, display device 128 is controlled such that representation 159 comprises current time zone reminder data, as depicted in FIG. 6, via a box 610. It is understood that the format in which the current time zone reminder data is displayed within representation 159 is generally non-limiting. It is furthermore understood that the box 610 (and the like) need not be displayed specifically within representation 159. For example, when the current time matches a time indicated in current time zone reminder data, computing device 110 can be controlling display device 128 to produce a representation of an application other than calendar application 131. In these embodiments, the display device 128 is controlled to produce box 610 within any suitable representation.

Continuing with the previous non-limiting example, again assuming that computing device 110 has been transported from first time zone to second time zone, and hence second set of event data 115-2 comprises the current time zone event data, reminders data associated with second set of event data 115-2 are correspondingly determined to comprise current time zone reminder data. For example, as depicted in FIG. 6, if the event "Vendor Meeting" is associated with reminder data indicative that "Provide Reminder 1 Hour Prior to Beginning of Meeting", then current time zone reminder data also comprises "Provide Reminder 1 Hour Prior to Beginning of Meeting".

Hence, as depicted in FIG. 6, and again assuming that computing device 110 has been transported to second time zone, box 610 is displayed in the time zone calendar view 116 at a time, in the current time zone (e.g. GMT), specified in the current time zone reminder data 116 (e.g. 1 hour before the beginning of the Vendor Meeting).

In general, reminder data for events in first event data 115-1 are generally not provided as they are not pertinent to the second time zone. This prevents reminder data from being processed that is not pertinent to the current time zone, and hence leads to more efficient use of system resources at computing device 110. For example, providing a reminder to "Staff Meeting" which is occurring in a first time zone while computing device 110 is in second time zone is generally a waste of processing time at computing device 110. This can further cause confusion for a user of computing device 110.

In another non-limiting example, first event data 115-1 can comprise alarm data. For example, first event data 115-1 can comprise alarm data which causes an alarm indication (e.g. an audio alarm, such as a wake up-call), to be provided at a given time each day. If such an alarm is generally provided at 6:00 a EST, then it is irrelevant to provide the alarm 1:00 a GMT. Indeed, this will result in confusion for a user of first computing device 110, and is further a waste of resources at computing device 110.

However, in some embodiments, calendar database 112 comprises data indicative of processing other time zone reminder data present in the calendar data base 112, other than current time zone reminder data. For example, first event data 115-1 can comprise data indicative that reminder data for the event "Staff Meeting" is to be provided regardless of the current time zone. Such an indication can be provided in reminder data associated with "Staff Meeting". Control of display device 128 to provide other time zone reminder data can be desired, in some embodiments, for example if a meeting is to be attended via telephone, and the like.

Hence, in some embodiments, it is determined which of the first and second time zones comprises a time zone other than current time zone, and hence which of first event data 115-1 and second event data 115-2, respectively, comprises other time zone event data. Subsequently, other time zone reminder data associated with the other time zone event data is processed to incorporate other time zone reminder data into time zone calendar view data 116 such that other time zone reminder data is displayed in time zone calendar view, similar to steps 450-460. Furthermore, other time zone reminder data is displayed at a time, in the current time zone, specified in other time zone reminder data, but shifted to the current time zone. Furthermore, in some embodiments, time zone reminder data can include an indication of the time in the other time zone.

Figure 7:
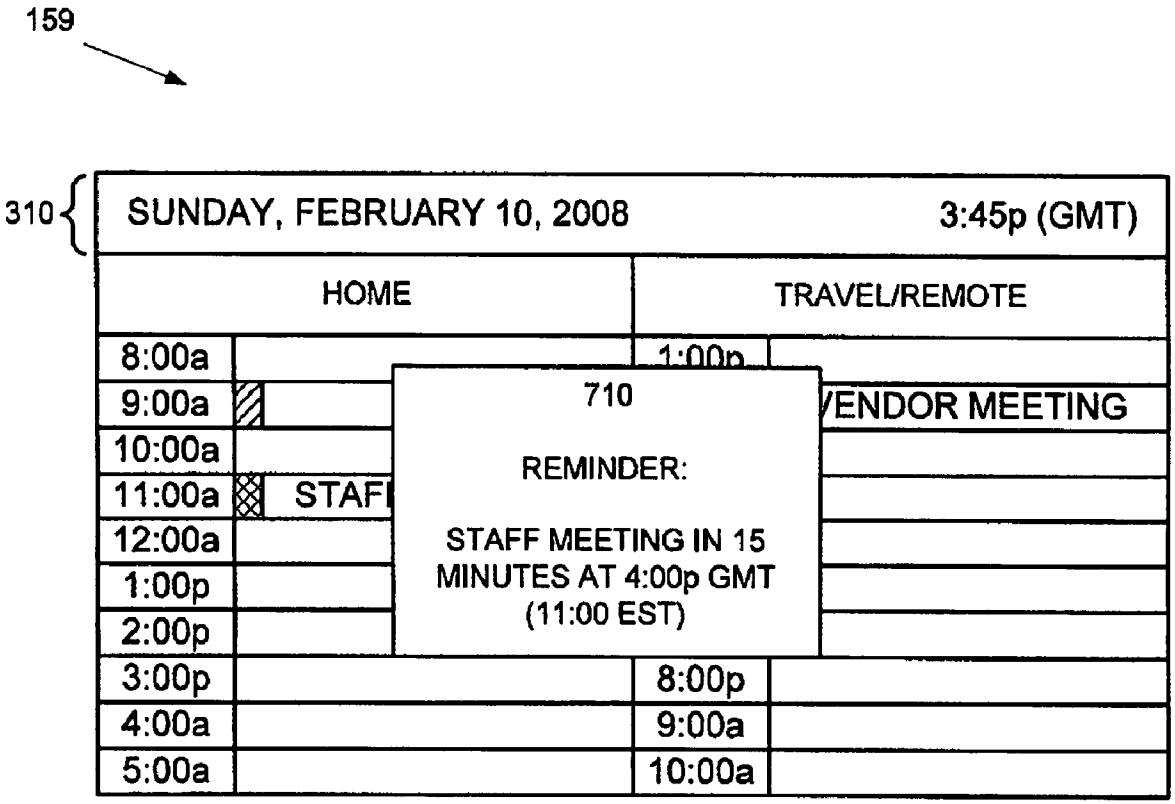

For example, first event data 115-1 can comprise data indicative that reminder data (i.e. other time zone reminder data) for the event "Staff Meeting" is to be incorporated into time zone calendar view data 116, regardless of the current time zone. Hence, as depicted in FIG. 7, in some embodiments, representation 159 can comprise a box 710 similar to box 610, but comprising a reminder of "Staff Meeting", the time that "Staff Meeting" is to begin in the current time zone (i.e. 4:00 p GMT), and a time that the "Staff Meeting" is to be begin in the home time zone (i.e. 11:00 a EST).

In some embodiments, method 400 can further comprise moving and/or copying event data from a first one of first event data 115-1 and second event data 115-2 to the other of first event data 115-1 and second event data 115-2. Such moving and/or copying can occur via receiving further input data from input device 126. Hence event data which is moved and/or copied between first event data 115-1 and second event data 115-2 will appear in representation 159 as an event occurring in the respective time zone.

In some embodiments, first computing device 110 can be configured with a trip duration time, which can include a start date/time and an end date/time. In these embodiments, a determination can be made, at any suitable point in method 400, whether a date/event etc. is inside or outside the time the trip is occurring. If inside, display device 128 is controlled, as in step 430, to produce the time zone calendar view. If outside, display device 128 can be controlled to revert to a standard calendar view (i.e. no need to provide a time zone calendar view), as when the date/event occurred/occurs first computing device 110 was/will be located in a home time zone.

Those skilled in the art will appreciate that in some embodiments, the functionality of first computing device 110 can be implemented using pre-programmed hardware or firmware elements (e.g., application specific integrated circuits (ASICs), electrically erasable programmable read-only memories (EEPROMs), etc.), or other related components. In other embodiments, the functionality of first computing device 110 can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Alternatively, the computer-readable program code could be stored remotely but transmittable to these components via a modem or other interface device connected to a network (including, without limitation, the Internet) over a transmission medium. The transmission medium can be either a non-wireless medium (e.g., optical and/or digital and/or analog communications lines) or a wireless medium (e.g., microwave, infrared, free-space optical or other transmission schemes) or a combination thereof.

A portion of the disclosure of this patent document contains material which is subject to copyright protection. The copyright owner has no objection to the facsimile reproduction by any one the patent document or patent disclosure, as it appears in the Patent and Trademark Office patent file or records, but otherwise reserves all copyrights whatsoever.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

What is claimed is:

1. A method of processing for time zone shifting a calendar database stored at a memory device, the method implementable in a computing device enabled to control a display device, comprising:

determining from the calendar database a first set of event data associated with a first time zone and a second set of event data associated with a second time zone;

producing time zone calendar view data to produce a time zone calendar view of representations of the first set and the second set comprising:

the first set and the second set comprising calendar events, free time, and indications of intervals of time in a given period, sorted according to their associated time zones, the representations displayed on respective timelines adjacent to one another with concurrent times in each of the respective timelines temporally aligned, each of the respective timelines corresponding to one of the first time zone and the second time zone and displayed as a time column adjacent an events column; and controlling the display device via the time zone calendar view data to produce the time zone calendar view.

2. The method of claim 1, further comprising:

determining which of the first time zone and the second time zone comprises a current time zone and, accordingly, which of the first set and the second set, respectively, comprises current time zone event data;

incorporating current time zone reminder data associated with the current time zone event data into the time zone calendar view data, such that the current time zone reminder data is displayed in the time zone calendar view at a time, in the current time zone, specified in the current time zone reminder data.

3. The method of claim 2, further comprising:

determining whether there is data indicative of processing other time zone reminder data present in the calendar database; and, if so determining which of the first time zone and the second time zone comprises a time zone other than the current time zone and, accordingly, which of the first set and the second set, respectively, comprises other time zone event data; and incorporating other time zone reminder data associated with the other time zone event data into the time zone calendar view data such that the other time zone reminder data is displayed in the time zone calendar view at a time, in the current time zone, specified in the other time zone reminder data shifted to the current time zone.

4. The method of claim 2, wherein the determining which of the first time zone and the second time zone comprises a current time zone comprises at least one of:

querying a communication network to determine the current time zone and comparing the current time zone with time zone data stored in the first set and second set;

receiving input data from an input device, the input data indicative of the current time zone, and comparing the event data with the time zone data;

querying a Global Positioning System (GPS) device to determine a current location and accessing a location-time zone database to determine the current time zone based on the current location; and querying the communication network to determine a network identifier and accessing a database of communication network identifiers to determine the current time zone based on the network identifier.

5. The method of claim 1, further comprising at least one of moving and copying event data from a first one of the first set and the second set to the other of the first set and the second set.

6. A computing device for time zone shifting a calendar database, comprising:

a memory for storing the calendar database;

a processing unit in communication with the memory, the processing unit enabled to:

determine from the calendar database a first set of event data associated with a first time zone and a second set of event data associated with a second time zone;

produce time zone calendar view data to produce a time zone calendar view of representations of the first set and the second set comprising:

the first set and the second set comprising calendar events, free time, and indications of intervals of time in a given period, sorted according to their associated time zones, the representations displayed on respective timelines adjacent to one another with concurrent times in each of the respective timelines temporally aligned, each of the respective timelines corresponding to one of the first time zone and the second time zone and displayed as a time column adjacent an events column; and control the display device via the time zone calendar view data to produce the time zone calendar view.

7. The computing device of claim 6, the processing unit further enabled to:

determine which of the first time zone and the second time zone comprises a current time zone and, accordingly, which of the first set and the second set, respectively, comprises current time zone event data; and incorporate current time zone reminder data associated with the current time zone event data into the time zone calendar view data, such that the current time zone reminder data is displayed in the time zone calendar view at a time, in the current time zone, specified in the current time zone reminder data.

8. The computing device of claim 7, the processing unit further enabled to:

determine whether there is data indicative of processing other time zone reminder data present in the calendar data base; and if so determine which of the first time zone and the second time zone comprises a time zone other than the current time zone and, accordingly, which of the first set and the second set, respectively, comprises other time zone event data; and incorporate the other time zone reminder data associated with the other time zone event data into the time zone calendar view data such that the other time zone reminder data is displayed in the time zone calendar view at a time, in the current time zone, specified in the other time zone reminder data shifted to the current time zone.

9. The computing device of claim 7, wherein the processing unit is enabled to determine which of the first time zone and the second time zone comprises a current time zone by at least one of:

querying a communication network to determine the current time zone and comparing the current time zone with time zone data stored in the first set and the second set, the computing device further comprising a communication interface enabled for the querying the communication network;

receiving input data from an input device, the input data indicative of the current time zone and comparing the event data with the time zone data, the computing device comprising the input device enabled for receiving input data;

querying a Global Positioning System (GPS) device to determine a current location and accessing a location-time zone database to determine the current time zone based on the current location; and querying the communication network to determine a network identifier and accessing a database of communication network identifiers to determine the current time zone based on the network identifier.

10. The computing device of claim 6, the processing unit further enabled to implement at least one of moving and copying event data from a first one of the first set and the second set to the other of the first set and the second set.

* * * * *